US008398196B2

(12) United States Patent
Smith

(10) Patent No.: US 8,398,196 B2
(45) Date of Patent: Mar. 19, 2013

(54) DROPLET SIZE IN INKJET PRINTING

(75) Inventor: Philip Russell James Smith, Cambridge (GB)

(73) Assignee: Inca Digital Printers Limited (GB)

( * ) Notice: Subject to any disclaimer, the term of this patent is extended or adjusted under 35 U.S.C. 154(b) by 703 days.

(21) Appl. No.: 12/524,494

(22) PCT Filed: Jan. 25, 2008

(86) PCT No.: PCT/GB2008/000269
§ 371 (c)(1),
(2), (4) Date: Oct. 2, 2009

(87) PCT Pub. No.: WO2008/090361
PCT Pub. Date: Jul. 31, 2008

(65) Prior Publication Data

US 2010/0110132 A1 May 6, 2010

(30) Foreign Application Priority Data

Jan. 25, 2007 (GB) ..... 0701450.9

(51) Int. Cl.
*B41J 29/38* (2006.01)
*B41J 29/393* (2006.01)
*B41J 2/155* (2006.01)
*B41J 2/05* (2006.01)

(52) U.S. Cl. ..... 347/14; 347/5; 347/10; 347/19; 347/42; 347/57

(58) Field of Classification Search ..... 347/5, 9–12, 347/14, 19, 41, 42, 57
See application file for complete search history.

(56) References Cited

U.S. PATENT DOCUMENTS

| | | | | |
|---|---|---|---|---|
| 6,488,351 | B1 | 12/2002 | Newkirk et al. | |
| 2001/0038397 | A1 * | 11/2001 | Kobayashi et al. | 347/14 |
| 2002/0075354 | A1 | 6/2002 | Andrews et al. | |
| 2004/0032617 | A1 | 2/2004 | Lapstun et al. | |
| 2004/0223015 | A1 * | 11/2004 | Couwenhoven et al. | 347/12 |
| 2006/0082604 | A1 | 4/2006 | Florence et al. | |
| 2006/0082606 | A1 * | 4/2006 | Hawkins et al. | 347/9 |
| 2006/0268036 | A1 * | 11/2006 | Knierim et al. | 347/14 |
| 2008/0122885 | A1 * | 5/2008 | Chwalek et al. | 347/9 |

FOREIGN PATENT DOCUMENTS

| | | | |
|---|---|---|---|
| EP | 0 649 746 | A1 | 4/1995 |
| EP | 0 827 838 | A2 | 3/1998 |
| EP | 0 867 284 | A2 | 9/1998 |
| EP | 1 319 511 | A1 | 6/2003 |
| EP | 1 621 346 | A2 | 2/2006 |
| WO | 2006-089105 | | 8/2006 |

OTHER PUBLICATIONS

GB Examination Report for Application No. GB 0701450.9 mailed Jan. 4, 2012 (7 pages).

* cited by examiner

*Primary Examiner* — Charlie Peng
*Assistant Examiner* — Hung Lam
(74) *Attorney, Agent, or Firm* — Harness, Dickey & Pierce, P.L.C.

(57) ABSTRACT

A printer control unit (3) is described for controlling the size of droplets emitted by a nozzle of a printhead (8) in an inkjet printer. The control unit (3) receives information about an image to be printed by the printer, for example from a raster image processor (5), the information including droplet size information regarding the size of droplet required to be emitted by the nozzle to print the image. Print parameter information for printing the image is determined on the basis of the received droplet size information, the print parameter information including information for use in setting the printer such that droplets emitted by the nozzle during the printing of the image have the required droplet size.

19 Claims, 3 Drawing Sheets

DROPLET SIZE IN INKJET PRINTING

This invention relates to inkjet printing. Aspects of the invention described herein relate to a method and apparatus for controlling droplet size in an inkjet printer. The invention finds particular application in drop on demand inkjet printers.

In an inkjet printing process, an array of droplets of, for example, ink is deposited onto the surface of a substrate in a pattern to form the required image. The droplets of ink are typically emitted from an array of nozzles of an inkjet printhead. A typical printer includes several printheads arranged in a printhead array. It is generally necessary for there to be relative movement between the printhead array and the substrate during the printing procedure for the whole of the required image to be printed onto the substrate.

Various types of printhead are available which emit droplets of the printing material (for example ink) using methods which are well known in the art.

Most commercial and industrial inkjet printers use a piezoelectric material to expel the droplets of ink from the printhead nozzles. In such printheads, each print nozzle is connected to an ink-filled channel associated with a piezoelectric material. When an electrical pulse is applied to the piezoelectric material, the material changes size or shape thus generating a pressure pulse in the ink in the channel and an ink droplet is emitted from the nozzle.

In a thermal inkjet printhead, a heating element is arranged adjacent the ink channel. An electrical pulse applied to the heating element causes a bubble to be formed in the ink channel, thus expelling a droplet of ink from the nozzle.

To obtain high quality images, it is necessary to control the volume of ink emitted as the droplet. One way in which the droplet size can be varied is by altering the pulse applied to eject the ink (the print pulse). In particular, the voltage applied and the pulse width is chosen so that the required volume of ink is emitted in each droplet.

The required printer parameters and settings (for example voltage and pulse width) for obtaining a particular droplet size of one type of printer will be different from those of a different printer, and the type of printhead and the ink used will also be factors. Generally, the pulse amplitude and pulse width are set on the basis of information provided by the printhead manufacturer as to the pulse to be applied to obtain the standard droplet size.

Thus the printhead arrangement is generally set to print droplets at a standard droplet size. This is often set to give a mass of ink of about 30 ng of ink in each drop. This is approximately equal to 30 pico liters of ink volume. Drop mass is generally easier to determine than actual drop volume and is a convenient way to determine drop size.

It has been found that for many applications, a drop size of about 30 ng is acceptable in that it gives reasonable print quality at an acceptable printing speed.

However, in some cases, it would be preferred to print using droplets of a different size. For example, smaller droplets can give better image quality due to improved print resolution and sharper image edges as well as a smoother finish, in particular for pale colours.

However, it is generally necessary to deposit a particular amount of ink onto the substrate to make an image, so that if the volume of each droplet is reduced, it will generally be necessary for more droplets to be deposited for the image to be printed. For example, if the droplet size is halved, then it may be necessary for twice as many droplets to be emitted for the same image to be printed using the small droplets compared with the larger droplets.

Therefore the data fed to the printheads for printing the 30 ng droplets will not be correct for printing using 15 ng droplets. Thus it is not possible just to change the printer arrangement to print smaller drops because insufficient droplets will then be laid down to make the image. Equally, if larger drops are substituted using the same image data, the substrate may become flooded with ink. Furthermore, the change of the droplet size parameters is not straightforward. The relationship between the pulse voltage and pulse width, and other factors is not a simple one.

The present invention seeks to address problems identified in the above prior art.

Accordingly, in a first aspect of the invention, there is provided a printer control unit for controlling the size of droplets emitted by a nozzle of a printhead in an inkjet printer, the control unit comprising: means for receiving information regarding an image to be printed by the printer, the information including droplet size information regarding the required size of droplet to be emitted by the nozzle to print the image; means for determining, on the basis of the received droplet size information, print parameter information for printing the image; the print parameter information including information for use in setting the printer such that droplets emitted by the nozzle during the printing of the image have the required droplet size.

Preferably the unit also includes means for transmitting the print parameter information to the printer and/or a component of the printer for setting the printer to print the image using the droplet size. The unit may be a part of the printer itself.

Thus in preferred embodiments of the invention, the printer is set to print the image in the predetermined droplet size associated with the image information. In particularly preferred examples, the whole image is printed using this predetermined droplet size. Preferably all of the droplets emitted by the nozzle during the printing of the image have the required droplet size, ie the same size. Thus in preferred examples, the droplet size settings are the same for the whole printing job for printing that image. Preferably the nozzle emits only droplets of the droplet size during the printing of the image. It will be appreciated that there would normally be some variation in the actual size of the droplets emitted by the nozzle due to variations in the nozzle performance as the printing is carried out.

It will be appreciated that the image referred to is preferably that which is printed during one print job or print operation. The image data for printing the image will generally be contained in one image file. It will be appreciated that the image referred to herein may in fact be a part of a larger image or part of a composite image for which several individual images are laid down separately to form the composite image.

The print parameter information is preferably transmitted directly to a component of the printer to effect the change in printer settings as appropriate. The transmitted information may also include the image data for effecting printing of the image, or this image information may be transmitted separately.

Preferably the means for determining the print parameter information comprises means for retrieving predetermined print parameter information associated with the required droplet size from a memory.

This memory may be a part of the control unit. In preferred arrangements, the print parameter information includes information regarding printer settings. Preferably the print parameter information includes information regarding the setup and/or general operation of components of the printer, rather than to data relating to the image to be printed. Thus preferably the print parameter information includes printer parameter and/or setting information. The information may comprise a plurality of groups of values of printer parameter settings, each group comprising printer settings for printing using each particular droplet size. The different parameters might be stored separately within the memory or may be stored as a group of parameters associated with the particular droplet size. The information may be stored in a look-up table. Thus the memory may include printer setting information regarding a plurality of discrete droplet sizes.

Thus the apparatus may include means for identifying from memory information regarding a plurality of printer settings associated with the droplet size.

Alternatively or in addition, some or all of the print parameter information may be calculated in dependence on the particular required droplet size. The information may be calculated on-the-fly.

Preferably the means for determining the print parameter information comprises means for calculating printer settings in dependence on the droplet size.

The printer settings may be calculated using predetermined formulae. In this way the printer settings can be calculated across a range of droplet sizes. However, in some cases this option may be less preferred since the calculations made may be less accurate than measured data points.

Preferably the print parameter information includes information regarding printer settings.

Preferably it includes information regarding several parameters of the printer to be set to achieve the desired droplet size during printing of the image.

The print parameter information may include information regarding the printing pulse for emitting droplets from the printhead nozzle.

The information may, for example, include information regarding the frequency, amplitude, pulse width, or other properties of the printing pulse.

The information may relate to the printing pulse for a whole printhead, a group of printheads, some of the nozzles of one or more printheads, or even a single printhead nozzle. In some arrangements, nozzles may be grouped together for activation with a single pulse or type of pulse. For example nozzles for printing a particular colour ink could be grouped together. The grouping of the nozzles is preferably determined on the basis of the amount of control required of the droplet size. For example, where the printer arrangement is such that, during printing, several different nozzles will be used to print a particular part of the image, the exact control of the droplet size for each nozzle may be less important than for an arrangement where only one, or a small number of nozzles are used to print a particular area. In the latter case, any variation in droplet size for a particular nozzle group may produce significant visual artifacts in the printed image.

The information may include information regarding the pulse voltage. It has been identified that in some arrangements it will be beneficial to alter the voltage on the basis of the droplet size since the voltage used affects the velocity of the emitted droplet and problems may be encountered if small drops are emitted at a low velocity.

The information may include information regarding the print pulse frequency. The frequency used is, in some examples, dependent on the droplet mass, the pulse width used, and other factors.

The information may include information regarding other printer settings, for example regarding the relative speed of movement of the printhead and the substrate onto which the image is being printed. As the amplitude of the print pulse is altered and the print droplet size is changed, the time taken for the drop to pass from the printhead to the substrate can be changed and this should be taken into account, in particular where the image is to be printed using bi-directional printing techniques.

The device for monitoring the amount of ink remaining for a printhead often uses droplet size information to determine how much ink is being used. Thus if the droplet size is reduced, then the ink will be used up more slowly per droplet. Thus the print parameter information preferably also includes information regarding the setting of the ink monitoring device.

The print parameter information may also include information regarding the temperature at which the printheads are operated. In some arrangements, the printhead may include a heater for use in achieving the desired ink temperature in the printhead.

The print parameter information may be determined on the basis of the type of printhead used, the type of ink used and/or the colour of ink used and/or other factors.

Preferably the unit is adapted to control the size of droplets emitted by a plurality of nozzles, the print parameter information for setting the printer including information for use in setting a plurality of nozzles to emit droplets having the required droplet size during the printing of the image. Thus groups of nozzles may be set individually to print droplets at a particular droplet size. For example, a printhead or groups of printheads may be set to print at a particular droplet size. For example, printheads for ink of on particular colour may be set to print at a particular droplet size, a different droplet size being set for another printhead or group of printheads.

The control unit may be adapted to control the size of droplets emitted by a first nozzle and a second nozzle of in an inkjet printer, wherein droplet size information includes information regarding two required sizes of droplet to be emitted to print the image, the print parameter information including information for use in setting the printer such that droplets emitted by the first nozzle during the printing of the image have a first required droplet size and droplets emitted by the second nozzle have a second required droplet size. Thus different nozzles or groups of nozzles can be set to print different sizes of droplets. For example, different printheads of the printer could be set to print different sizes of droplets. Thus some printheads may print small droplets at the same time as other printheads are printing large droplets. In this way, areas of the image requiring smaller droplet size (for example areas of light tone) can be printed using small droplets, while other areas (for example large areas of solid fill or for sharp edges of an image) can be printed using larger droplets. In these arrangements, it is still preferred that each nozzle or group of nozzles prints droplets only at the single droplet size for the whole print job.

A particularly important feature of examples of the invention is that the printer settings can be set automatically for printing the image on the basis of the received information regarding droplet size.

Preferably the control unit includes means for determining the printer settings used for printing a previous image.

Even where the settings for the printer are changed automatically, there is time associated with changing the settings. Thus it would be advantageous to avoid changing the settings needlessly. Thus preferably the control unit includes means for determining whether the printer settings are already set for the desired values for printing at the droplet size required for the next image. If they are, then no further change needs to be made in some arrangements, or the number of changes can be reduced.

Preferably the control unit includes means for determining the printer settings used for printing a previous image and includes means for comparing the received drop size information with drop size information for a previous image.

Information regarding the previous droplet size could be stored in memory. If the comparison indicates that the droplet size information for the previous image was the same as for the present image, it might be assumed that the printer is already set to print at the required droplet size, and thus that no further action is required regarding the changing of any printer settings.

Alternatively, one or more printer parameter settings could be determined to make an assessment as to the droplet size for which the printer is currently set, and a determination made as to whether or not further changes are required.

Alternatively, the printer control unit could be adapted to save information regarding the settings for the previous image printed. This information could then be compared with information for the current image to be printed to determine whether any changes in the settings are required.

Preferably the control unit is arranged to receive the droplet size information from a raster image processor. The droplet size information may not be received directly from the RIP, but might be first subject to additional processing.

Since the number of droplets to be printed will generally depend on the size of the droplets being emitted, the size of droplets to be emitted will often need to be decided at the RIP (raster image processing) stage. Thus preferably the control unit receives both bitmap image information from the RIP and information as to the droplet size for which the image information has been processed.

The invention also provides an apparatus including a control unit described herein and a raster image processor means. The raster image processor will generally be implemented in software.

While the RIP could be carried out at the printer control unit, in many examples, it will be preferred for the RIP to be carried out in a separate specialised RIP.

Preferably the RIP is adapted to transmit to the control unit information regarding an image to be printed, wherein the information includes droplet size information regarding the size of droplet to be emitted by a printhead to print the image.

Preferably the image information comprises a job file into which is embedded the droplet size information. The print job file will typically consist of some header information such as required print resolution, image size, original image name, process date, processing parameters used, carriage positions for each pass and then a series of image fragments, arranged so that for each pass of the engine there is one fragment for each printhead. The droplet size information may be included in header in the file.

As indicated above, the RIP and the control unit could be combined and the output of the RIP might effectively then be the printer settings which would be sent directly to the printer. However, in this case the RIP may need to be specific to that particular printer or type of printer which may reduce the flexibility of the system. In some preferred examples, the RIP is separate from the printer driver which includes the printer control unit for determining the printer settings. This means that the same job file can be run on different physical printers and achieve the same result, even though the printers may have different voltage/pulse width sensitivities. Similarly a job file will give a consistent result after an individual printhead has been replaced, even though the sensitivities of the two printheads may be different.

Preferably the apparatus includes means for receiving input into the RIP information regarding droplet size for the image to be printed.

This information may be input by the user, for example from a drop-down list. As indicated above, in some arrangements it will be preferable for the droplet size information to relate to one of a plurality of discrete droplet sizes. The droplet size chosen by the user may be identified quantitatively (for example 15 ng, 22 ng, 30 ng) or may be identified qualitatively (for example small, regular, large).

Preferably the arrangement includes means for identifying that no droplet size information is available, and determining information relating to default settings for printing the image.

If no specific droplet size is identified for the printing of a particular image, it would be preferable for example for the image to be printed using the "regular" droplet size rather than the last droplet size settings used. Thus if the control unit does not receive droplet size information with the image information, or if the RIP does not obtain droplet size information, then preferably the apparatus is adapted to set the printer to the default settings for printing the image.

Preferably the apparatus further includes a printer and a printhead arranged to receive print parameter information from the control unit.

The invention further provides a raster image processor, preferably for use in association with a control unit as described herein, the RIP being adapted to output, information regarding an image to be printed, wherein the information includes droplet size information regarding the size of droplet to be emitted by a printhead to print the image.

The invention further provides an image file, preferably including bitmap information regarding an image to be printed using an inkjet printer, and further including information regarding the droplet size of the droplets to be emitted by the printer to print the image.

Further provided by the invention is a set of predetermined printer settings for an inkjet printer, each of the settings relating to the emission of a different droplet size by a printhead of the printer.

The invention further provides a method of controlling the size of droplets emitted by a nozzle of a printhead in an inkjet printer, the method comprising: receiving information regarding an image to be printed by the printer, the information including droplet size information regarding the required size of droplet to be emitted by the nozzle to print the image; determining, on the basis of the required droplet size information, print parameter information for printing the image; and using the print parameter information to set the printer so that droplets emitted by the nozzle have the required droplet size.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

The invention also provides a signal embodying a computer program for carrying out any of the methods described herein and/or for embodying any of the apparatus features described herein, a method of transmitting such a signal, and a computer product having an operating system which supports a computer program for carrying out any of the methods described herein and/or for embodying any of the apparatus features described herein.

The invention extends to methods and/or apparatus substantially as herein described with reference to the accompanying drawings.

Any feature in one aspect of the invention may be applied to other aspects of the invention, in any appropriate combination. In particular, method aspects may be applied to apparatus aspects, and vice versa.

Furthermore, features implemented in hardware may generally be implemented in software, and vice versa. Any reference to software and hardware features herein should be construed accordingly.

Preferred features of the present invention will now be described, purely by way of example, with reference to the accompanying drawings, in which.

Figure 1:
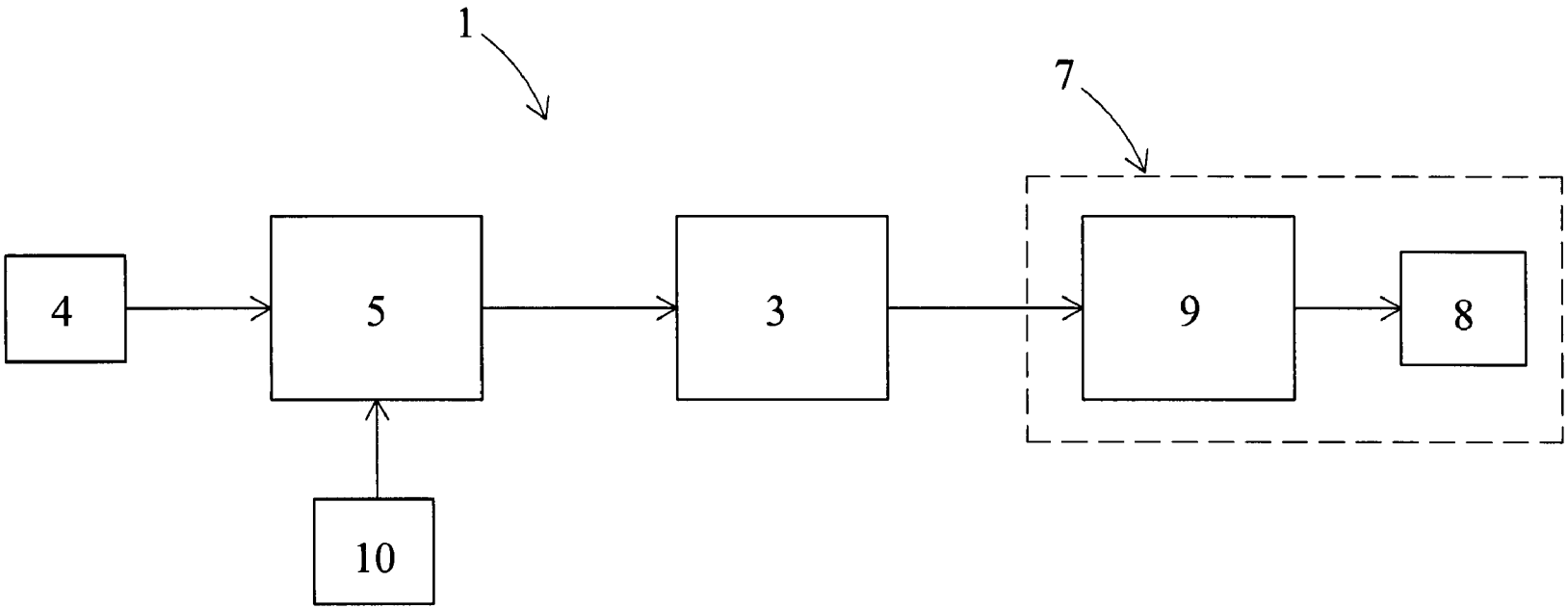
FIG. 1 shows schematically a printer control arrangement

FIG. 1 shows schematically the components of a printer control arrangement 1 including a printer control unit 3, a raster image processor 5 (RIP) and printer components 7 for effecting printing onto a substrate using printhead 8 controlled by printhead driver components 9.

Image data is fed into the RIP 5, for example from an image creation and editing device 4. The image data input into the RIP 5 may include, for example, vector and raster digital image information such as PostScript, PDF, JPG, EPS, TIFF or other image file formats. The RIP 5 may comprise software running on a general purpose or specialised computer as is known in the art. For example, the RIP may be based on a Software RIP of Wasatch Computer Technology suitably adapted for the present application as described in more detail below. Generally, the image data input into the RIP is image data which is transferred into bitmap data at a resolution and orientation suitable for transmission to the printer control unit 3. The RIP performs scaling, rotation, colour conversion and halftoning operations, as well as data formatting, and optionally tiling and multi-image layout.

The image information is then transmitted to the printer control unit 3. The printer control unit in this case comprises software running on a general or specialised computer. In this example, the computer running the printer control unit software is different from that running the RIP software, but the two components could be run on the same computer. The printer control unit 3 reads the image data sent from the RIP and translates the data into print instructions which are sent to the printer components 7 to effect printing of the image using the printheads 8. While the printer components are shown separate from the printer control unit 3 and the RIP 5, one or more of the other components could be included in the printer.

In a preferred example of the invention, the RIP is associated with a droplet size input device 10. For example, an operator of the RIP may input the required droplet size data when prompted by the RIP software running on the computer. For example, the software may include means for presenting a drop-down list on the computer screen, the drop down list including several different droplet size options from which the operator can select. The operator inputs his selection into the RIP, and the RIP then determines the image data to be sent to the printer control unit. In a preferred example, the bitmap image data to be sent to the printer control unit 3 is in the form of an image file into which is embedded data as to the droplet size to be used for printing the image. The droplet size information is preferably included in a header of the file.

The image data file is then sent to the printer control unit 3. It will be appreciated that there need not be a physical link between the RIP 5 and the printer control unit 3. For example, the connection may be a wireless connection and/or a network connection, which may include an Internet connection. Also it will be appreciated that the image information output from the RIP could be loaded onto a data carrier, for example a disc for later loading into the printer control unit 3. Similarly, the link between the printer control unit and the printer components 7 might not be a physical one and the comments above made in respect of the link between the RIP and printer control unit 3 apply equally to the link between the printer control unit 3 and the printer components 7.

Figure 2:
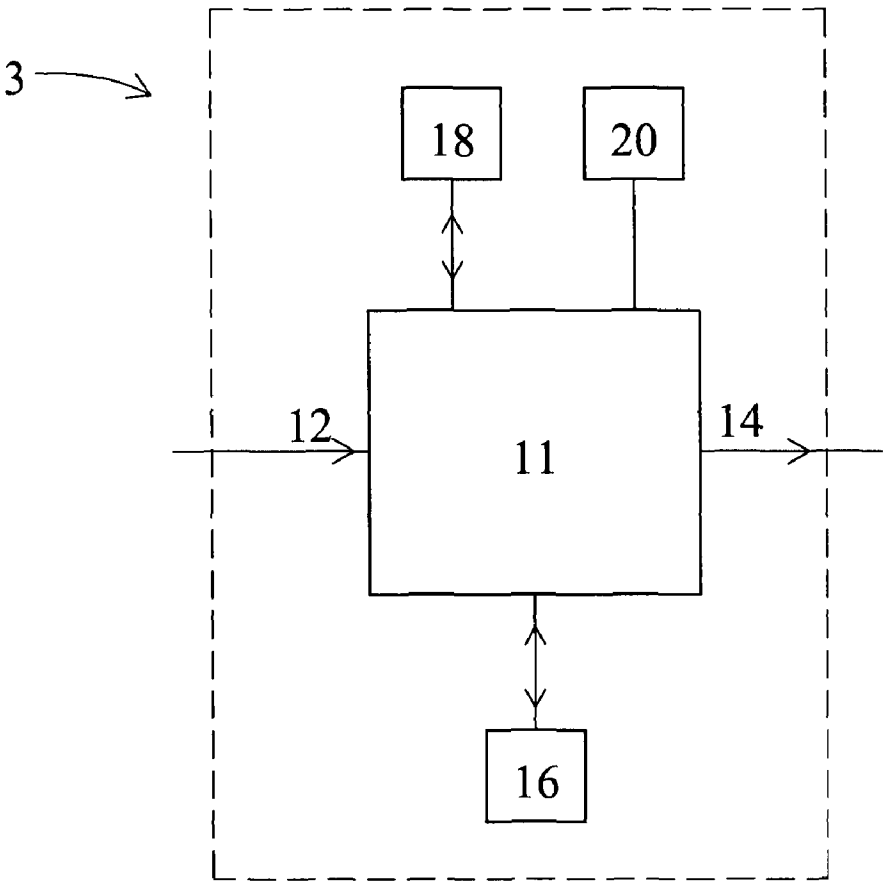
FIG. 2 shows schematically further features of the printer control unit

FIG. 2 shows schematically further features of the printer control unit 3. The printer control unit 3 includes a processing unit (11) including an input 12 for receiving the image information from the RIP 5, and an output 14 for transmitting print parameter information to the print components to effect the printing of the image. The printer control unit further includes two memory stores 16 and 18 for storing information used in the determining of the print parameter information. These components of the printer control unit 3 may be provided by a general purpose or specialised computer.

With reference to FIG. 2, an example of the operation of the printer control unit 3 is now described. The printer control unit 3 receives at the input 12 the print image file transmitted from the RIP 5 as described above and analyses it at the processing unit 11. The file is first analysed to determine whether or not the file includes any data relating to droplet size. If there is no droplet size information, then default printer settings are retrieved from the default memory 18 and are used to determine print parameter information for printing the image. The default printer settings will generally be such that the image will be printed using a default or standard droplet size, for example 30 ng droplet mass.

If droplet size information is detected, it is retrieved. The processing unit 11 then retrieves information from the memory store 16 and uses the retrieved information to determine print parameter information for printing the image.

It will be appreciated that the function of the two memory stores could be provided by a single component.

The information retrieved from the memory store 16 or the default memory store 18 includes information regarding one or more printer settings or values or printing parameters, the value of which determine the size of droplet emitted by the printhead of the printer and/or the operation of the printer at that particular droplet size. In preferred examples, a group of printer settings is retrieved associated with the particular droplet size information which was received with the file.

The printer settings and printing parameters may include one or more of the following:

1. Print pulse amplitude
2. print pulse width
3. print pulse voltage
4. print pulse frequency
5. print pulse timing (for example if an adjustment is required to be included in view of droplet time-in-flight considerations)
6. operation of an ink level monitoring device
7. temperature of ink at printhead
8. relative speed of movement of the printhead and substrate
9. print height (gap)
10. Curing power It will be appreciated that other settings and parameters may be included.

The print parameter information may comprise the data regarding the settings and/or parameters. This data would then be sent to the printer components for use in setting the printer settings and/or determining the print instructions on the basis of the image data. Alternatively, or in addition, the printer control unit may carry out further processing of the information and output print commands to the printer components, for example it may output print pulses direct to the printhead control units. Thus some or all of the further processing to determine the print commands may be carried out at the printer control unit, in the printer components, or in a combination of the two. Some print parameter information may be sent to the printer components before printing of the image commences for changing printer settings globally before printing starts, for example to effect operation of a heater unit to change the temperature of the ink at the printheads. Alternatively or in addition the print parameter information may be transmitted during or after printing.

Alternatively or in addition, the printer control unit may retrieve from memory 16 and/or 18 formulae or other calculation data for calculating one or more of the settings and printer parameters and the processor is adapted to calculate the print parameter information using the formula or other data and/or to send the formula or other data to the printer components 7 for further calculation.

Where the settings for the printer have been changed from the default settings for a particular print job, the system may be arranged such that the settings are changed back to the default settings on completion of the print job.

When a new image file is input into the printer control unit 3 and is processed, the printer control unit is adapted to determine whether the printer settings for the present print job are the same or different from the current printer settings. If there is no change or few changes, then efficiencies can be made in that certain print parameter information need not be sent to the printer components and some processing at the printer control unit might be avoided thus leading to time savings.

The determination may be carried out by the processing unit 11 analysing the printer settings directly to determine the current settings and then comparing them to the required printer settings for a particular subsequent print job.

Alternatively or in addition, when determining the printer settings required to print a particular image, the processor unit stores to settings memory 20 (which may be provided by components of memory 16 and/or default memory 18) information regarding printer settings for the printing of that image. Then, when the settings for the subsequent image are being calculated, the processing unit 11 is adapted to retrieve settings information from the settings memory 20 with regard to the previous image (which could be expected to correspond to the current printer settings). The settings information for the previous image is then compared with that for the current image. If part or all of the settings information is the same, then the processor unit determines the print parameter information to be sent to the printer accordingly.

In the arrangement where the printer is reset to the default settings after each image is printed, as required, the comparison of the printer settings would then be compared with the default settings to determine whether any change in settings of the printer is required for the current image.

Where information regarding more than one image is received at the printer control unit at one time, ie more than one job is loaded at once, the printer control unit is adapted in some examples to review the printer settings required for each image or group of images to be printed and to determine a printing order for the print jobs, preferably to reduce the number of changes of printer settings required to print the images.

Preferably the printer control unit comprises a specific driver for a particular printer. Alternatively, or in addition, the printer control unit could be adapted for determining print parameter information for use in several different printers or types of printers.

For example, the printer control unit could include several memory stores, each including information regarding one or more printer settings or values or printing parameters for a different printer. In determining the print parameter information, information is retrieved from the memory appropriate to the printer for which the print parameter information is intended.

It will appreciated that some or all of this functionality could be provided as a part of the RIP.

Determining information regarding printer settings and printing parameters relating to the different droplet sizes is preferably carried out by experiment. For a particular printer, the various parameters and settings are altered and test images are printed to determine preferred or optimum parameters and settings having regard to, for example, image quality and speed of printing.

It is envisaged that more than one group of printer settings and parameters might be associated with each droplet size. For example, different settings might be made available depending on the print quality required. For example, for a droplet size of 15 ng, there may be two sets of printer settings provided: one relating to high quality low speed printing and the other relating to lower quality high speed printing. The operator would choose when the print instructions were being determined which set of settings to use, or alternatively this choice might have been made at the RIP stage. The set of information regarding the printer settings and printing parameters may be provided independently by the invention. This information may be provided for example on a data carrier to be loaded into the printer control unit.

It will be seen that the RIP 5 could be used to carry out some or all of the operations of the printer control unit and to output print parameter information. However, in some cases such an arrangement is not preferred since the output of the RIP may then be specific to a particular printer. It is envisaged, however, that the RIP could be adapted to prepare print instructions for a selected one of a number of different printers, the RIP and other processing of the data being carried out on the basis of the type of printer specified by the operator.

Alternatively, the RIP could be carried out at the printer control unit and/or at the printer itself, but this arrangement is difficult for high speed printers, as the rip process can interfere with the printing in some cases, and a separate RIP would therefore be preferred.

Figure 3:
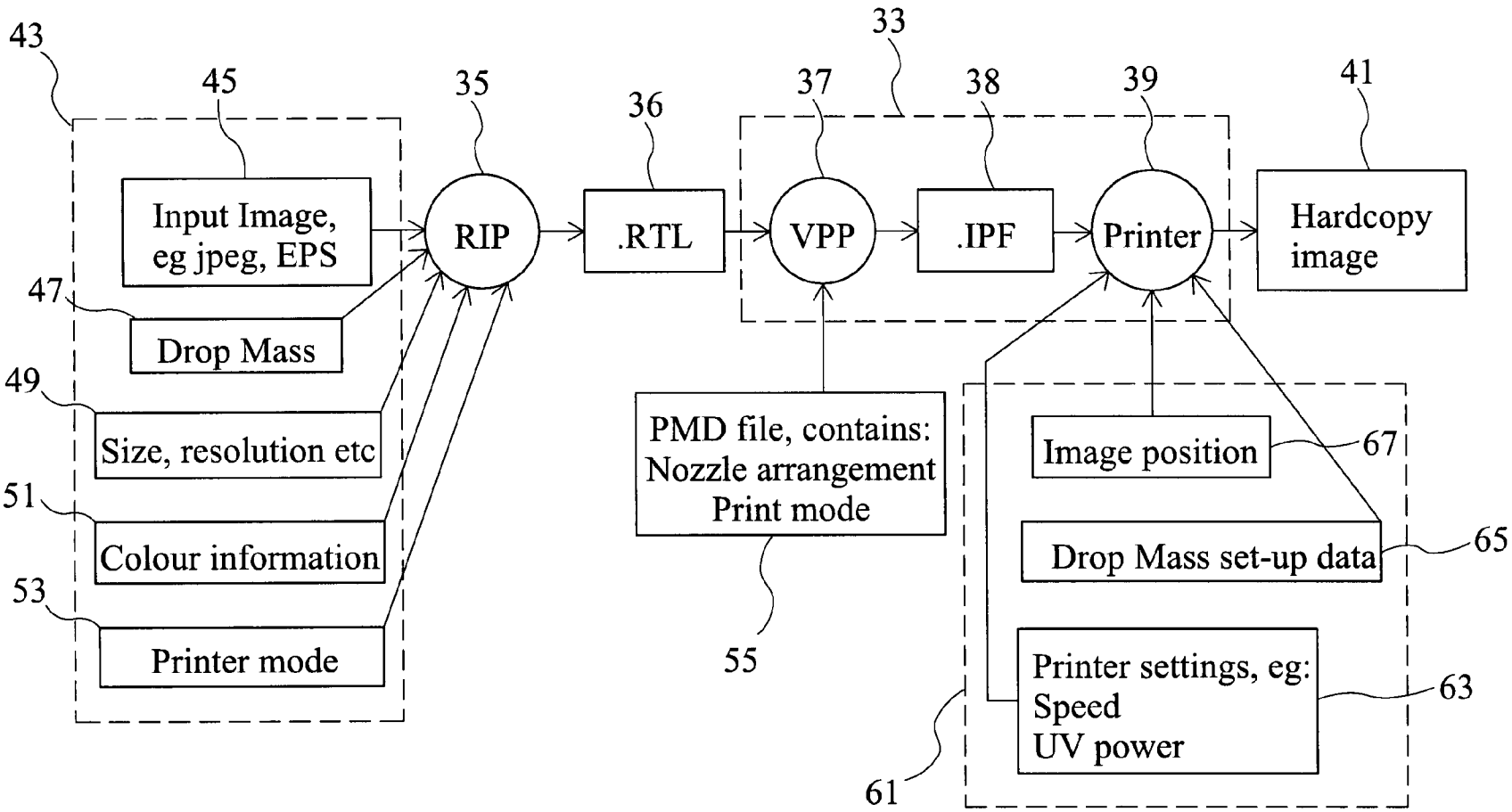
FIG. 3 shows schematically the steps in processing information in the printer control arrangement.

FIG. 3 shows schematically the steps carried out in an example of processing information in the printer control arrangement. In this arrangement, the RIP 35 receives various data inputs and outputs a .RTL file 37 to the printer processing unit 33. In this arrangement the printer processing unit includes a VPP 37 and further processing units in the printer components at the printer 39 including the printer control unit. In this arrangement, the VPP is a program which is run on a computer separate from the printer 39. The VPP 37 takes the output of the RIP 35 (the .RTL file) and, following processing steps outlined below, outputs a print job file (the .IPF file 38) to the printer 39. The output of the printer 39 is the printed image 41.

The RIP inputs 43 include the image file 45, for example a jpeg or EPS file, information regarding the required drop mass 47, information regarding the required image size and resolution 49, colour information 51 and printer mode to be used 53. These inputs 43 may be input into the RIP 35 for example through a software user interface of the RIP 35. The RIP 35 translates the data in the image file 45 into initial print instructions in the form of the .RTL file 36 in accordance with the other information input 43 including the drop mass information 47. The .RTL file 36 includes a header comprising information including the required print resolution, image size, image name, printer mode in addition to the droplet size information.

The .RTL file 36 is received by the VPP 37 which carries out processing of the .RTL file information. The VPP processing is specific to the printer or type of printer being used to print the image and VPP inputs include information regarding the arrangement of the nozzles in the printer and the print mode to use. The VPP 37 analyses the image data in the .RTL file 36 and allocates all of the pixels to be printed to specific printer nozzles of the printer 39. As a part of this processing, information the x,y coordinates of the drops to be printed is determined; since the .RTL file 36 is not printer-specific, it contains no information as to the nozzle arrangement to be used to print the image or other information regarding the physical arrangement of the printer.

The VPP 37 obtains from the PMD file input 55 information regarding the nozzle arrangement for the printer and therefore the VPP 37 determines which nozzle is to be used to print each pixel based on the nozzle arrangement and the print mode.

The output of the VPP 37 is the .IPF file 38 which includes printer-specific print instructions for printing the image by the printer 39. Information regarding the droplet size, and other information, is copied from the header of the .RTL file 36 to the header of the .IPF file 38. Once processed by the VPP 37, the .RTL file 36 may be deleted, or they might be stored for future use, for example if the same image is to be reprinted using a different print mode or printhead arrangement, in which case the information in the .RTL file 36 would be reprocessed by the VPP 37 using a different PMD file input 55.

Thus the .IPF file 38 comprises the print job file which is input into the printer 39 for effecting printing. In this case, the .IPF file 38 includes header information such as the required print resolution, image size, original image name, process date, processing parameters used as well as carriage positions to be used for each printing pass. The file also includes print image data including data regarding image fragments, each fragment being for printing by a single printhead in a pass of the printheads over the substrate being printed so that the full image data is printed by a set of printheads, each printing an image fragment.

The .IPF file 38 is input into the printer where further processing steps are carried out such that signals are generated to effect the emission of droplets from the nozzles of the printheads to effect printing of the image 41. As discussed further above, the printer control unit, which is here incorporated as a component of the printer 39, identifies the droplet size information contained in the .IPF file 38. The printer control unit then identifies the printer settings to be used to print the image using the particular droplet size for that file 38. Any necessary printer settings are then changed prior to the image being printed.

As illustrated in FIG. 3, printer inputs 61 are provided at the printer. These include print parameter information, for example printer setting information 63, drop mass set up data 65 for example print pulse data relating to particular droplet size. Further inputs can be provided, for example image position information 67 relating to the positioning of the image of the substrate. This information may conveniently stored in a computer memory being a part of, of associated with the printer itself; in particular the printer setting information is preferably stored on the computer. Alternatively or in addition, some or all of the information may be input separately, for example by a user using a computer software interface.

It will be appreciated that other arrangements are possible. For example, the functionality of the VPP 37 may be carried out in the printer 39. Indeed the VPP processing may be carried out together with any additional processing at the printer 39 so that a separate .IPF file 38 is not generated. Alternatively, some or all of the VPP processing may be carried out by the RIP 35. In this case, the .RTL 36 may not be generated.

Each image file may include information about printing a single pass using the printer, or may include information regarding printing several passes of a printhead over the substrate being printed.

Method of Determining Droplet Size

The droplet size may be determined as follows:

An absorbent pad is weighed.

The nozzle for which the droplet size is to be determined or the group of nozzles for which the average droplet size is to be determined is arranged adjacent the absorbent pad and the printheads are fired such that a known number of droplets of ink are emitted from the nozzles onto the pad.

The pad is weighed again and the average droplet size is determined knowing the number of droplets emitted by each nozzle and the number of nozzles.

Thus it will be appreciated that where reference is made herein to droplet size for a group of nozzles, preferably the term will be understood to refer to the average droplet size as appropriate.

It will be understood that the present invention has been described above purely by way of example, and modification of detail can be made within the scope of the invention.

Each feature disclosed in the description, and (where appropriate) the claims and drawings may be provided independently or in any appropriate combination.

The invention claimed is:

1. A printer control unit for controlling the size of droplets emitted by all nozzles of a printhead in an inkjet printer, the printer control unit comprising:

means for receiving information regarding an image to be printed by the printer, the information including droplet size information regarding a single required size of the droplets to be emitted by all the nozzles to print the image, the single required size of the droplets selected from a plurality of different droplet sizes;

means for determining, on the basis of the received droplet size information, print parameter information for printing the image;

the print parameter information including information regarding the printer settings for which droplets emitted by all the nozzles during the printing of the image have the single required droplet size.

2. The printer control unit according to claim 1, further including means for transmitting the print parameter information to the printer for setting the printer to print the image using the single required size of the droplets.

3. The printer control unit according to claim 1, wherein the means for determining the print parameter information comprises means for retrieving predetermined print parameter information associated with the single required size of the droplets from a memory.

4. The printer control unit according to claim 1, wherein the means for determining the print parameter information comprises means for calculating printer settings on the basis of the single required size of the droplets.

5. The printer control unit according to claim 1, wherein the print parameter information includes information regarding printer settings.

6. The printer control unit according to claim 1, wherein the print parameter information includes information regarding the printing pulse for emitting the single required size of the droplets.

7. The printer control unit according to claim 1, adapted to control the size of droplets emitted, the print parameter information for setting the printer including information for use in setting all the nozzles to emit droplets having the single required size of the droplets.

8. The printer control unit according to claim 1, further including means for determining the printer settings used for printing a previous image.

9. The printer control unit according to claim 8, wherein the means for determining the printer settings used for printing the previous image includes means for comparing the required drop size information with drop size information for the previous image.

10. The printer control unit according to claim 1 arranged to receive the droplet size information from a raster image processor.

11. An apparatus including the printer control unit according to claim 1 and a raster image processor (RIP) means.

12. The apparatus according to claim 11, the RIP being adapted to transmit, information regarding an image to be printed, wherein the information includes droplet size information regarding the single required size of the droplets to be emitted by the printhead to print the image.

13. The apparatus according to claim 11 including means for receiving into the RIP information regarding the single required size of the droplets for the image to be printed.

14. The printer control unit according to claim 1, further comprising means for identifying that no droplet size information is available, and determining information relating to default settings for printing the image.

15. An apparatus according to claim 1, wherein the inkjet printer and the printhead are arranged to receive print parameter information from the printer control unit.

16. A raster image processor (RIP), preferably for use in association with the printer control unit according to claim 1, the RIP being adapted to output information regarding an image to be printed, wherein the information includes droplet size information regarding the single required size of the droplets size of droplet.

17. A method of controlling the size of droplets emitted by all nozzles of a printhead in an inkjet printer, the method comprising:

receiving information regarding an image to be printed by the printer, the information including droplet size information regarding a single required size of the droplets to be emitted by all the nozzles to print the image, the single required size of the droplets selected from a plurality of different droplet sizes;

determining, on the basis of the required droplet size information, print parameter information for printing the image; and using the print parameter information to set the printer for printing the image so that the droplets emitted by all the nozzles have the single required droplet size.

18. The method according to claim 17, further including the step of transmitting the print parameter information to the printer.

19. A method for controlling droplet size of droplets emitted by all nozzles of a printhead in an inkjet printer during printing of an image, the method comprising:

receiving at an image processor a droplet size input and an image input, the droplet size input identifying a single required size of the droplets to be used to print an entirety of the image the single required size of the droplets selected from a plurality of different droplet sizes;

translating the image input into initial print instructions in accordance with the droplet size input using the image processor, the initial print instructions are not printer specific;

allocating to all the nozzles of the printhead the pixels to be printed by each one of the nozzles based on the initial print instructions, the allocation is specific to the printhead and includes nozzle arrangement of the printhead;

generating a print job file based on the initial print instructions and the allocation of pixels to the nozzles of the printhead, the print job file including printer specific print instructions for printing the image by the printer;

inputting the print job file to a printer control unit of the printer;

identifying the droplet size input included in the print job file using the printer control unit;

identifying printer settings required to print the image with the single required droplet size specified in the droplet size input using the printer control unit; and printing the image based on the print job file and the droplet size input included therein.

* * * * *